US012296930B2

(12) United States Patent
LaSee

(10) Patent No.: US 12,296,930 B2
(45) Date of Patent: May 13, 2025

(54) DOCK-LAUNCHING SYSTEM FOR KAYAKS

(71) Applicant: Jack LaSee, Abbotsford, WI (US)

(72) Inventor: Jack LaSee, Abbotsford, WI (US)

( * ) Notice: Subject to any disclaimer, the term of this patent is extended or adjusted under 35 U.S.C. 154(b) by 131 days.

(21) Appl. No.: 18/055,924

(22) Filed: Nov. 16, 2022

(65) Prior Publication Data

US 2023/0227133 A1 Jul. 20, 2023

Related U.S. Application Data

(60) Provisional application No. 63/301,188, filed on Jan. 20, 2022.

(51) Int. Cl.
*B63C 3/06* (2006.01)
*B63C 3/10* (2006.01)

(52) U.S. Cl.
CPC . *B63C 3/06* (2013.01); *B63C 3/10* (2013.01)

(58) Field of Classification Search
CPC ..... B63C 3/06; B63C 3/10; B63C 3/00
USPC ..... 405/1, 3
See application file for complete search history.

(56) References Cited

U.S. PATENT DOCUMENTS 5,158,032 A * 10/1992 Pitt ..... B60P 1/14 414/490
5,803,003 A * 9/1998 Vickers ..... B63C 3/06 405/3
9,527,562 B1 * 12/2016 Sterling ..... B63C 15/00
2018/0105237 A1 * 4/2018 Surges ..... B63C 3/12

* cited by examiner

*Primary Examiner* — Sean D Andrish
(74) *Attorney, Agent, or Firm* — Boyle Fredrickson, SC

(57) ABSTRACT

A kayak launching system provides a vertical support pole and submersible rack arms extending out from a dock beneath the water. The rack arms may be lowered to allow a kayak to be positioned above them and then raised to stabilize the kayak during entrance or exit.

14 Claims, 3 Drawing Sheets

DOCK-LAUNCHING SYSTEM FOR KAYAKS

CROSS REFERENCE TO RELATED APPLICATION

This application claims the benefit of U.S. provisional application 63/301,188 filed Jan. 20, 2022, and hereby incorporated by reference.

BACKGROUND OF THE INVENTION

The present invention relates to systems for launching kayaks and in particular to a system that allows a single kayak user to launch in deep water from a dock.

It is very difficult to launch a kayak from a dock because of the loss of stability while getting into the kayak. The easiest launch situation is when the kayak is in 1-2 inches of sand and water, where it is extremely stable but, in that situation, either a second person must be enlisted to push the kayak out into deeper water, or the individual must balance on the kayak while they simultaneously push off from the ground, something that is difficult for individuals who are disabled or have limited mobility.

SUMMARY OF THE INVENTION

The present invention provides a dock-mounted support for the kayak that stabilizes the kayak on supporting arms while the individual embarks. Movement of a lever lowers the supporting arms to release the kayak for use or raises the supporting arms to capture the kayak when it is time to disembark. Additional adjustments allow setting the height of the supporting arms with respect to a particular dock and raising the supporting arms above the disembarking position for kayak storage.

More specifically, in one embodiment, the invention provides a kayak launching system having a submersible kayak rack sized, in a submerged state, to receive a kayak thereabove and, in a raised state, to stabilize the kayak for entrance or exit. A dock mount is provided that is attachable to a dock and a lift communicates between the submersible kayak rack and the dock mount to move the submersible kayak rack between the submerged state and the raised state. A support pole extends upwardly from the dock mount near a dock edge to support an individual entering or exiting a kayak on the submersible kayak rack in the raised state.

It is thus a feature of at least one embodiment of the invention to provide the effect of being in shallow water when launching from a dock in deep water through the use of a submersible kayak rack allowing partial support of the kayak by the rack and partial support by buoyancy of the kayak.

The lift maybe a lever arm having a pivot proximate to the support pole and a lever arm lifting strap attached to the submersible kayak rack to elevate the submersible kayak rack to the raised state when the lever arm is elevated and to lower the submersible kayak rack when the lever arm is lowered to the submerged state.

It is thus a feature of at least one embodiment of the invention to provide a simple mechanism for quickly raising and lowering the submersible rack between two defined positions.

The lever may releasably lock when elevated.

It is thus a feature of at least one embodiment of the invention to ensure stability during embarking and disembarking.

The pivot may be attached to slide with respect to the dock mount to be adjustably positioned in height.

It is thus a feature of at least one embodiment of the invention to accommodate different heights of water with respect to the dock to properly balance weight support between buoyancy and the submersible rack.

The kayak launching system may further include a second lift communicating between the submersible kayak rack and the dock mount to move the submersible kayak rack between the raised state and a storage state above the raised state.

It is thus a feature of at least one embodiment of the invention to allow the launching system to also store the kayak out of the water.

The second lift may connect in parallel to the first lift to allow independent movement of the submersible kayak rack by either the lift or second lift.

It is thus a feature of at least one embodiment of the invention to provide independent mechanisms for elevating the submersible rack to preserve the simple fixed range control of the lever.

The submersible kayak rack may provide at least one pivoting arm attached to a rack pivot supported by the dock mount and wherein the submersible kayak rack moves between the submerged state and raised state by pivoting about the rack pivot.

It is thus a feature of at least one embodiment of the invention to provide a simple mechanism for raising and lowering the submersible rack through a pivot.

The rack pivot may be positioned beneath the dock when the dock mount is attached to a dock edge.

It is thus a feature of at least one embodiment of the invention to employ a pivot while minimizing angulation of the pivoting arms by displacement of the pivot point away from the kayak.

The kayak launching system may further include a third lift communicating between the rack pivot and the dock mount to move the rack pivot in elevation with respect to the dock mount.

It is thus a feature of at least one embodiment of the invention to permit adjustment of the kayak launching system to accommodate differences in water height with respect to the dock.

The dock mount may include flexible straps sized to pass around the dock and to pull the dock mount against a dock edge of the dock when tightened. Alternatively, the mounting plate may include bolt holes for attaching the mounting plate to the dock with bolts, lag screws or the like.

It is thus a feature of at least one embodiment of the invention to provide a simple method of attaching the kayak launching system to a dock.

These particular objects and advantages may apply to only some embodiments falling within the claims and thus do not define the scope of the invention.

DETAILED DESCRIPTION OF THE PREFERRED EMBODIMENT

Figure 1:
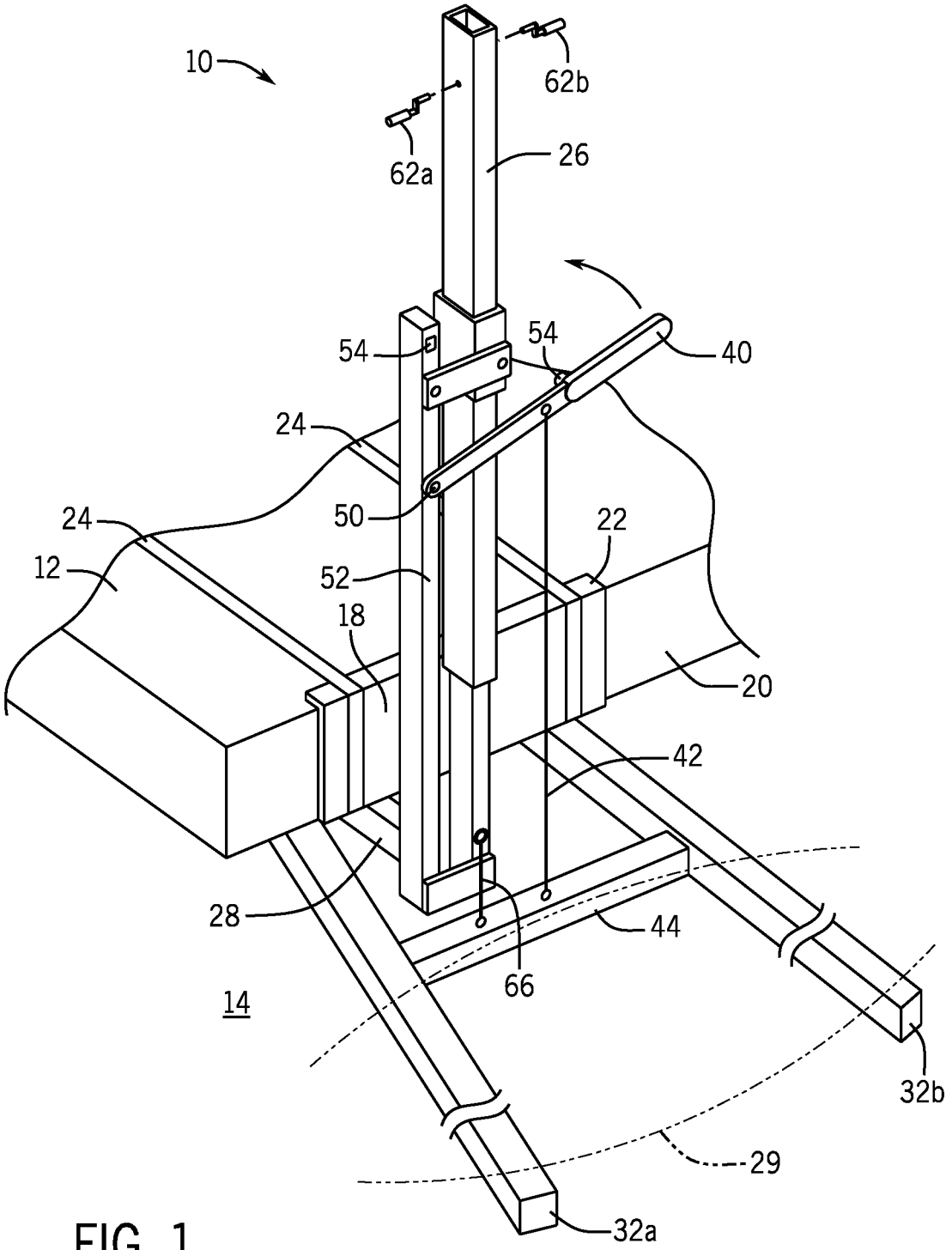
FIG. 1 is a fragmentary perspective view of the kayak launching system as mounted to a dock for use.

Referring now to FIG. 1, a kayak launching system 10 of the present invention is adapted for use with a dock 12 providing an upper surface for supporting foot traffic and positioned above a body of water 14 proximate to the water surface. The dock 12 may be supported on pilings or floats or the like (not shown) and may provide a vertical dock edge 20.

The kayak launching system 10 attaches a dock mounting plate 18 to the dock 12 at the vertical dock edge 20, for example, the dock mounting plate 18 being a metal plate sized to fit against the vertical dock edge 20 and having an upper inwardly extending perpendicular lip 22 resting against the upper surface of the dock 12 as so positioned. One or more nylon straps 24 may encircle the dock 12 and the dock mounting plate 18 as so positioned and be tightened with ratchet tighteners (not shown) to pull the dock mounting plate 18 against the vertical dock edge 20, allowing the dock mounting plate 18 to be readily attached to a variety of different docks 12 without permanent attachment. Bolt holes are also provided in the dock mount plate 18 to provide an alternative mechanism to attach it to the dock 12, for example, with lag screws or the like.

A vertical stabilizing tube assembly 26 is supported by the mounting plate 18 to extend vertically upward there from and provides a convenient grip for those embarking or disembarking on a kayak 29 (shown in phantom) positioned to the side of the dock 12 in the water 14. In one embodiment, the vertical stabilizing tube may be a 2"×2" aluminum tube 4 feet tall. The vertical stabilizing tube assembly 26 also supports various lift elements as will be discussed in greater detail below. The vertical stabilizing tube assembly 26 may be attached to the mounting plate 18 by a lockable pivot (not shown) allowing it to be adjusted to be vertical irrespective of the verticality of the vertical dock edge 20.

Figure 5:
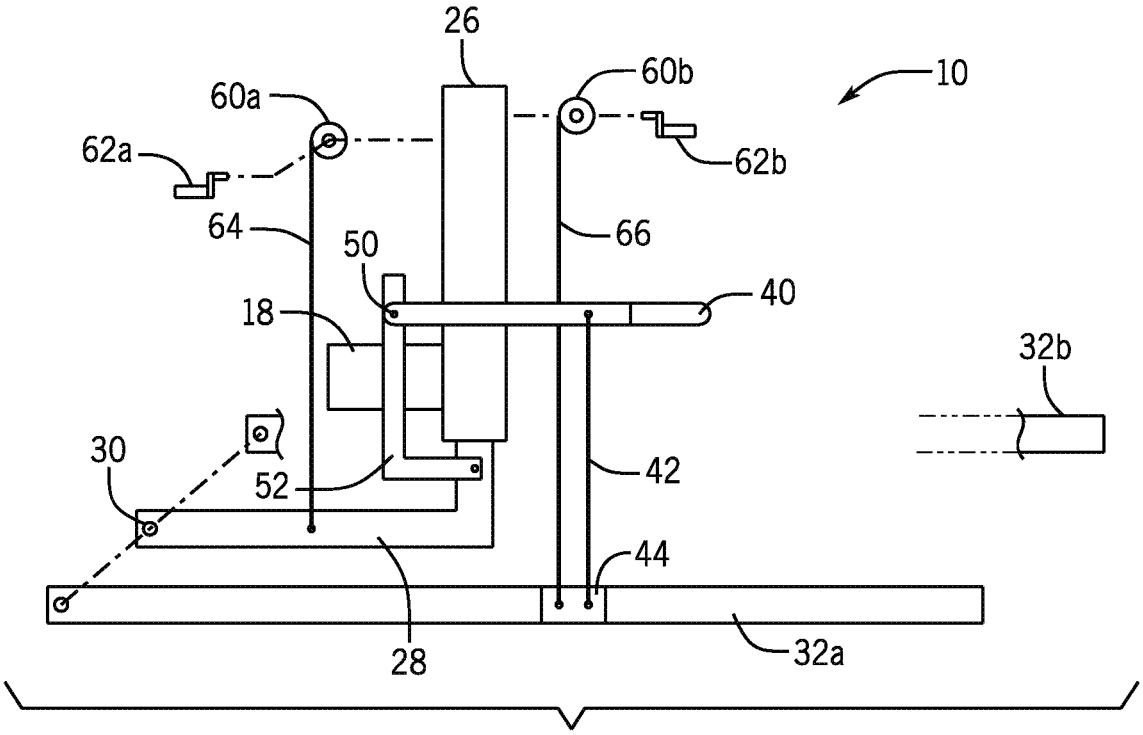
FIG. 5 is a diagrammatic representation of the interconnection of the components of the kayak launching system.

Referring now also to FIG. 5, extending in telescopic fashion downwardly from the stabilizing tube assembly 26 is a pivot arm 28 which may descend into the water from the bottom of the dock mounting plate 18 by 1 to 3 feet and then project rearwardly underneath the dock 12 to define a pivot 30 displaced under the dock 12 behind the dock edge 20. A first and second kayak rack arm 32*a* and 32*b* may attach pivotally at one end to the pivot 30 beneath the dock 12 and then extend approximately horizontally outwardly past the dock edge 20 to a position underneath an intended location of the kayak 29. The lift arms 32*a* and 32*b* may be spaced apart by approximately 3 feet at their free ends and thus splay outward horizontally from each other.

Figure 2:
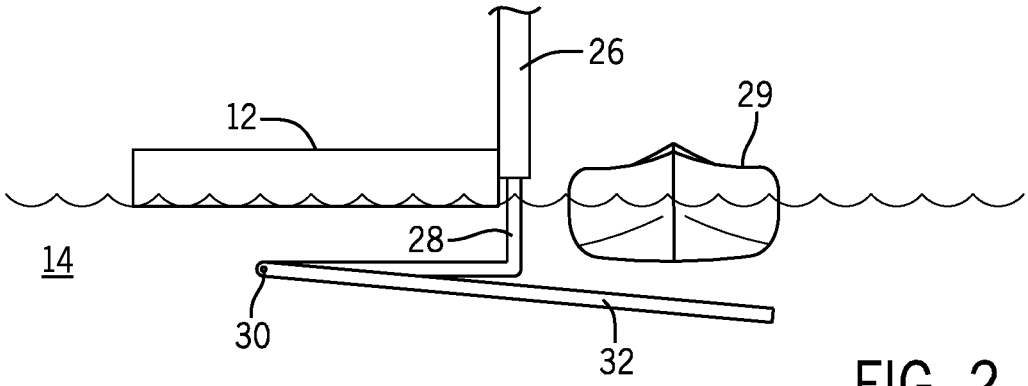
FIG. 2 is a simplified side elevational view of the kayak system after release of the kayak.

Referring now to FIG. 2, during operation, the rack arms 32 may be lowered by pivoting about the pivot 30 to a submerged state position with their free ends below a kayak 29 (preferably below a loaded kayak holding an individual floating in the water 14) to allow the kayak 29 to be freely positioned next to the dock 12 and the vertical stabilizing tube assembly 26.

Figure 3:
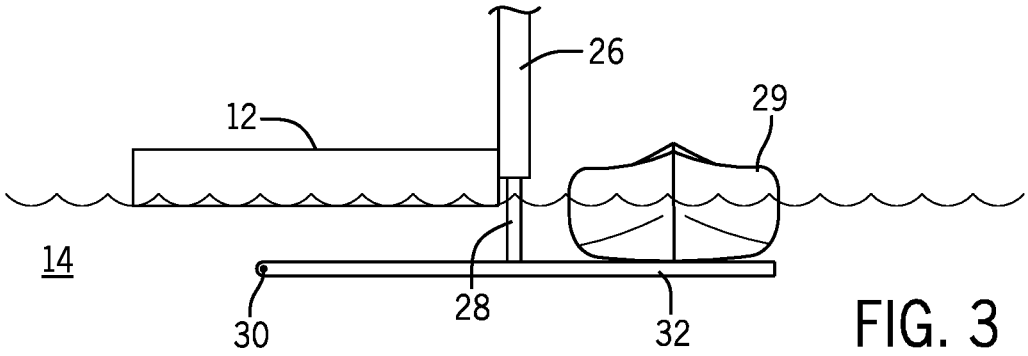
FIG. 3 is a figure similar to that of FIG. 2 showing partial support of the kayak by the submerged track for embarking and disembarking.

Referring to FIG. 3, the rack arms 32 may then be raised by pivoting the lever 40 (shown in FIG. 1) to a vertical position so that the rack arms 32 pivot about the underwater pivot 30 to an approximately 4° to 5° above horizontal position elevated by 3 to 7 inches at the outside end of lift arms 32 and partially supporting the kayak 29 to stabilize it for egress or ingress, the top of the rack arms 32 contacting the bottom of the kayak 29. In this state, an individual can enter or exit the kayak using the vertical stabilizing tube assembly 26 for stabilization. As partially supported by the water 14, in this state, the kayak 29 behaves as if it were in shallow 1 to 2 inch water.

Figure 4:
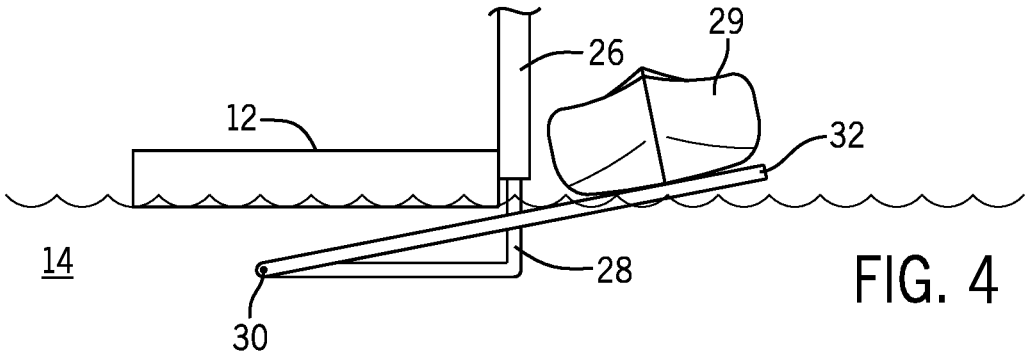
FIG. 4 is a figure similar to FIGS. 2 and 3 showing a raising of the kayak out of the water for storage.

Finally and referring to FIG. 4, the rack arms 32 may be raised by pivoting to storage state lifting the kayak out of the water 14 for storage.

Referring again to FIGS. 1 and 5, movement between the submerged position of FIG. 2 and the raised state of FIG. 3 may be accomplished by a lever 40 communicating via a flexible nylon strap 42 with a tie bar 44 extending between the arms 32. When the lever 40 is in the horizontal position, the arms 32 may be in the submerged state of FIG. 2, and when the lever 40 is moved to a vertical position (a quarter turn), the arms 32 may move to the raised state of FIG. 3. The lever 40 may be readily operated by an individual in the kayak 29 (either seated or standing and supported by the vertical stabilizing tube assembly 26). To provide for mechanical advantage, the nylon strap 42 is placed between a moving end of the lever 40 and a pivot 50 of that lever arm. The nylon strap 42 also provides a shock absorbing feature reducing stresses on the mechanism.

The pivot 50 of the lever 40 may be attached by means of side bracket 52 to the pivot arm 28 so as to naturally adjust the pivot 50 and hence the lever 40 up and down with movement of the pivot arm 28 so that the raised state of FIG. 3 will provide substantially, 4° to 5° raising up raising up, horizontal arms 32 for stable support of the kayak 29 for embarking and disembarking, and so that the storage state of FIG. 4 will provide upwardly tipped arms 32 for support of the kayak 29 out of the water without sliding off of the arms 32, in both cases regardless of the height of the pivot 50. Generally the lever 40 is bi-stable, for example, in the vertical orientation, locked by means of releasable lock elements 54 engaging on the lever 40 and the side bracket 52. Alternatively, locking may be obtained by moving the lever to an over-center position against a stop.

The arms 32 may include vinyl upper bumpers for better gripping of the kayak 29 and the protection of its surfaces.

The vertical stabilizing tube assembly 26 may contain a first and second winch 60*a* and 60*b* each receiving a corresponding crank arm 62*a* or 62*b* for operation and providing lift functions. The winch 60*a* may provide a nylon strap or cord 64 communicating between the vertical stabilizing tube assembly 26 and the pivot arm 28 to raise and lower the pivot arm 28 for initial setting of the kayak launching system 10 for a particular dock 12 and relative water height.

The winch 60*b* may attach in parallel, by nylon strap or cord 66, to the arms 32 (via crossbar 44) to independently operate to lift the arms 32 allowing the arms 32 to be moved to the storage stage shown in FIG. 4. This independent operation is facilitated by flexibility of the nylon strap 66.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom", and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context. As used herein, "nylon strap" refers generally a braided flexible nylon member of arbitrary cross-section including a rope, cord, web or the like. Elastic refers to a material having an effective Young's modulus of less than 4 GPa including nylon, rubber, and the effective property of many springs.

When introducing elements or features of the present disclosure and the exemplary embodiments, the articles "a", "an", "the" and "said" are intended to mean that there are one or more of such elements or features. The terms "comprising", "including", and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

I claim:

1. A kayak launching system comprising:

a submersible kayak rack having longitudinally separated arms sized to receive a kayak thereabove, in a submerged state, and to stabilize the kayak for entrance or exit, in a raised state;

a dock mount attachable to a dock;

a lift communicating between the submersible kayak rack and the dock mount to move the submersible kayak rack between the submerged state and the raised state and positioned to be operable by an individual in the kayak; and a support pole positioned between the longitudinally separated arms toward a center of the kayak as stabilized and extending upwardly from the dock mount near a dock edge to support an individual entering or exiting the kayak on the submersible kayak rack in the raised state;

further including a second lift communicating between the submersible kayak rack and the dock mount to move the submersible kayak rack between the raised state and a storage state above the raised state; and wherein the second lift connects in parallel to the lift to allow independent movement of the submersible kayak rack by either of the lift or the second lift.

2. The kayak launching system of claim 1 wherein the lift is a lever arm having a pivot proximate to the support pole and attached to the submersible kayak rack to elevate the submersible kayak rack to the raised state when the lever arm is elevated and to lower the submersible kayak rack when the lever arm is lowered to the submerged state.

3. The kayak launching system of claim 2 wherein the lever arm releasably locks when elevated.

4. The kayak launching system of claim 2 wherein the pivot is attached to slide with respect to the dock mount to be adjustably positioned in height.

5. The kayak launching system of claim 1 wherein the lift is a lever arm and an elastic strap communicating between the submersible kayak rack and the support pole.

6. The kayak launching system of claim 5 wherein the strap is a nylon strap.

7. The kayak launching system of claim 1 wherein the second lift is a winch and an elastic strap communicating between the submersible kayak rack and the support pole.

8. The kayak launching system of claim 7 wherein the strap is a nylon strap.

9. The kayak launching system of claim 1 wherein the dock mount includes at least one of flexible straps sized to pass around the dock and to pull the dock mount against a dock edge of the dock when tightened and bolt holes for receiving fasteners attaching the dock mount to the dock.

10. A kayak launching system comprising:

a submersible kayak rack having longitudinally separated arms sized to receive a kayak thereabove, in a submerged state, and to stabilize the kayak for entrance or exit, in a raised state;

a dock mount attachable to a dock;

a lift communicating between the submersible kayak rack and the dock mount to move the submersible kayak rack between the submerged state and the raised state and positioned to be operable by an individual in the kayak;

a support pole positioned between the longitudinally separated arms toward a center of the kayak as stabilized and extending upwardly from the dock mount near a dock edge to support an individual entering or exiting the kayak on the submersible kayak rack in the raised state; and wherein the submersible kayak rack provides at least one pivoting arm attached to a rack pivot supported by the dock mount and wherein the submersible kayak rack moves between the submerged state and raised state by pivoting about the rack pivot.

11. The kayak launching system of claim 10 wherein the rack pivot is positioned beneath the dock when the dock mount is attached to a dock edge.

12. The kayak launching system of claim 10 further including a second lift communicating between the rack pivot and the dock mount to move the rack pivot in elevation with respect to the dock mount.

13. The kayak launching system of claim 12 wherein the second lift is a winch and an elastic strap communicating between the submersible kayak rack and the support pole.

14. The kayak launching system of claim 13 wherein the strap is a nylon strap.

* * * * *